US009739467B1

(12) United States Patent
Lehman et al.

(10) Patent No.: US 9,739,467 B1
(45) Date of Patent: Aug. 22, 2017

(54) PORTABLE LIGHT DEVICE WITH HEADLIGHT AND FRONT FLOODLIGHT PANEL

(71) Applicants: Gregg Lehman, Peachtree City, GA (US); Adam Green, Marietta, GA (US); Anthony Ryan Gibbs, Atlanta, GA (US); James Richard Christ, Peachtree City, GA (US)

(72) Inventors: Gregg Lehman, Peachtree City, GA (US); Adam Green, Marietta, GA (US); Anthony Ryan Gibbs, Atlanta, GA (US); James Richard Christ, Peachtree City, GA (US)

(73) Assignee: Cooper Technologies Company, Houston, TX (US)

( * ) Notice: Subject to any disclaimer, the term of this patent is extended or adjusted under 35 U.S.C. 154(b) by 208 days.

(21) Appl. No.: 14/563,480

(22) Filed: Dec. 8, 2014

Related U.S. Application Data

(60) Provisional application No. 61/913,126, filed on Dec. 6, 2013.

(51) Int. Cl.

| | |
|---|---|
| ***F21V 3/04*** | (2006.01) |
| ***F21V 23/04*** | (2006.01) |
| ***F21L 2/00*** | (2006.01) |
| ***F21V 7/00*** | (2006.01) |
| ***F21L 4/02*** | (2006.01) |

(52) U.S. Cl.
CPC ..... *F21V 23/0414* (2013.01); *F21L 2/00* (2013.01); *F21L 4/025* (2013.01); *F21L 4/027* (2013.01); *F21V 7/00* (2013.01)

(58) Field of Classification Search
CPC ... F21L 2/00; F21L 4/025; F21L 4/027; F21V 7/00; F21V 23/0414
See application file for complete search history.

(56) References Cited

U.S. PATENT DOCUMENTS

| | | | | |
|---|---|---|---|---|
| 7,234,833 | B2 * | 6/2007 | Hatherill | F21L 4/08 362/191 |
| 7,334,918 | B2 * | 2/2008 | Newton | F21L 14/023 362/227 |
| 7,897,277 | B2 * | 3/2011 | Meyer | F21L 2/00 429/100 |

* cited by examiner

*Primary Examiner* — Stephen F Husar
(74) *Attorney, Agent, or Firm* — King & Spalding LLP

(57) ABSTRACT

A portable light device includes a headlight disposed at one end of the portable light device. The headlight is adjustable and can be directed to a variety of angles. The headlight includes a reflector with facets and at least one light source positioned approximately in an optic center of the reflector. Further, the portable light device includes a floodlight panel disposed at a front side of the portable light device. The flood light panel includes one or more light sources and each light source is covered by a primary optic.

20 Claims, 11 Drawing Sheets

PORTABLE LIGHT DEVICE WITH HEADLIGHT AND FRONT FLOODLIGHT PANEL

CROSS REFERENCE TO RELATED APPLICATIONS

This application claims priority to U.S. Provisional Application No. 61/913,126 filed on Dec. 6, 2013 and entitled "Portable Light with Headlight and Front Floodlight Panel," the entire content of this provisional patent application being incorporated herein by reference.

TECHNICAL FIELD

Embodiments of this disclosure relate generally to electrical lighting devices, and more particularly, to a portable light device with headlight and front floodlight panel.

BACKGROUND

There is often a need to enhance illumination of an area by using portable lighting products. One such portable lighting product is a flashlight or a stick light, which may be used in various settings that need light in small spaces, including, but not limited to, a repair setting such as an automotive repair shop, a construction setting, and other areas where no electrical outlet exists. Certain drawbacks with conventional flashlights are that they may provide insufficient illumination and that they often cannot be positioned easily for hands-free use.

SUMMARY

The present disclosure addresses the above-mentioned shortcomings with a portable light device that includes a headlight configured to provide a focused illumination and a floodlight configured to provide a general illumination of an area.

In one aspect, a portable light device includes a headlight disposed at one end of the portable light device. Further, the headlight includes a reflector with facets and at least one light source positioned approximately in an optic center of the reflector. In addition to the headlight, the portable light device includes a floodlight panel disposed on a front side of the portable light device. The floodlight panel includes one or more light sources, and each light source of the floodlight panel is covered by a respective primary optic.

In another aspect, a portable light device includes an elongated body having a first end and a second end. Further, the portable light device includes a headlight disposed at the first end of the elongated body. The headlight includes a reflector with facets and at least one LED light source. The second end of the elongated body includes a base. Further, the portable light device includes a floodlight panel disposed on a front side of the elongated body. The floodlight panel includes one or more LED light sources, and each light source is covered by a respective primary optic.

In yet another aspect, a portable light device includes a headlight disposed at one end of the portable light device. The headlight includes a reflector with facets. Further, the portable light device includes a floodlight panel disposed on a front side of the portable light device one or more light sources, where each light source is covered by a respective primary optic. In addition, the headlight is adjustable to provide a beam of light in the same direction as a beam of light emitted by the floodlight panel.

These and other aspects, features, and embodiments of the present invention may be more clearly understood and appreciated from a review of the following detailed description of the disclosed embodiments and by reference to the drawings and the claims.

BRIEF DESCRIPTION OF THE FIGURES

Embodiments are illustrated by way of example and not limitation in the figures of the accompanying drawings, in which.

Figure 1:
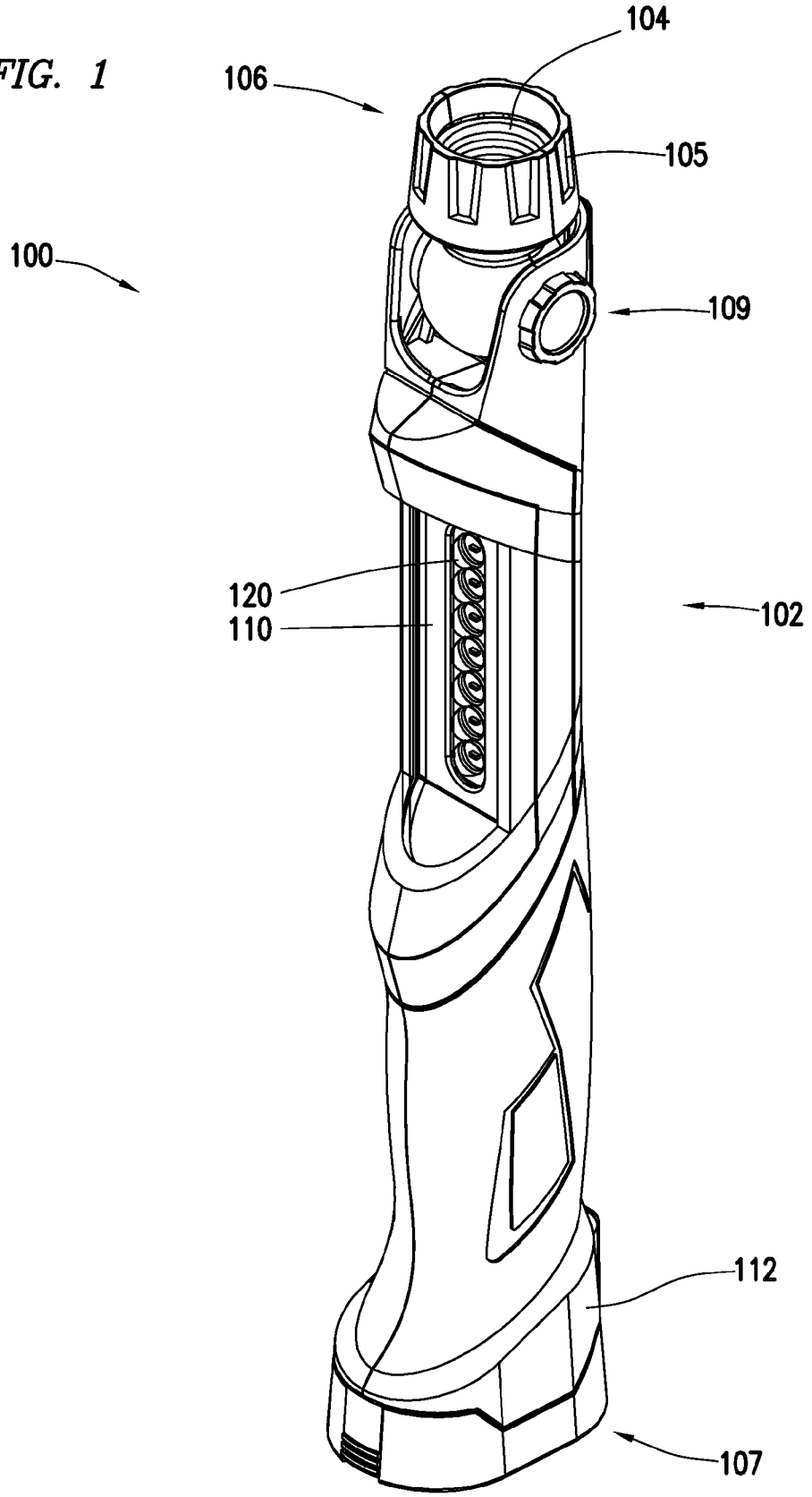
FIG. 1 is a perspective view of a portable light device in accordance with an example embodiment.
Figure 2:
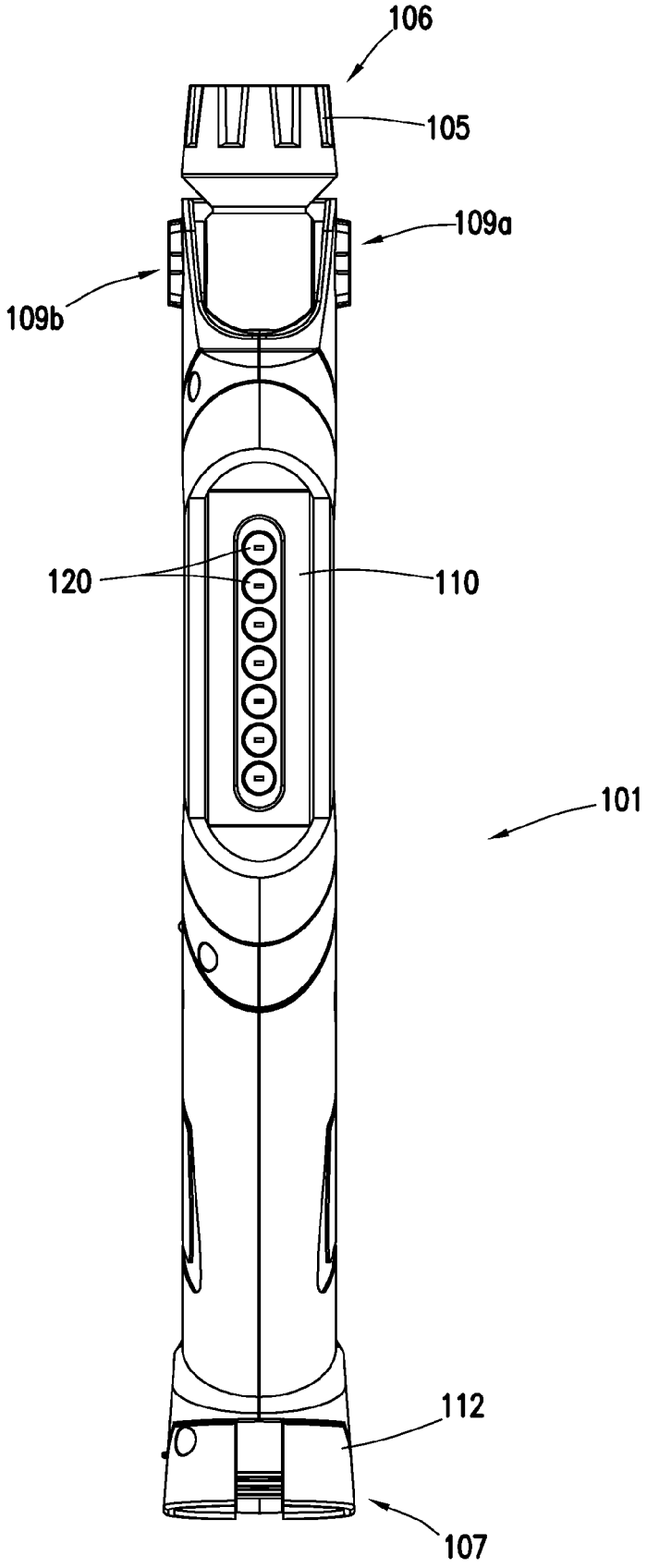
FIG. 2 is a front view of the portable light device of FIG. 1 in accordance with an example embodiment.

Many aspects of the example embodiments can be better understood with reference to the above drawings. The elements and features in the drawings are not to scale; emphasis is instead placed upon clearly illustrating the principles of example embodiments. Moreover, certain dimensions may be exaggerated to help visually convey such principles. In the drawings, reference numerals designate like or corresponding, but not necessarily identical, elements throughout the several views. Other features of the example embodiments will be apparent from the Detailed Description that follows.

DETAILED DESCRIPTION OF EXAMPLE EMBODIMENTS

Example embodiments disclosed herein are directed to a portable light device with a headlight and a front floodlight panel. Example embodiments are described herein with reference to the attached figures, however, these example embodiments are not limiting and those skilled in the art will appreciate that various modification are within the scope of this disclosure.

Figure 7:
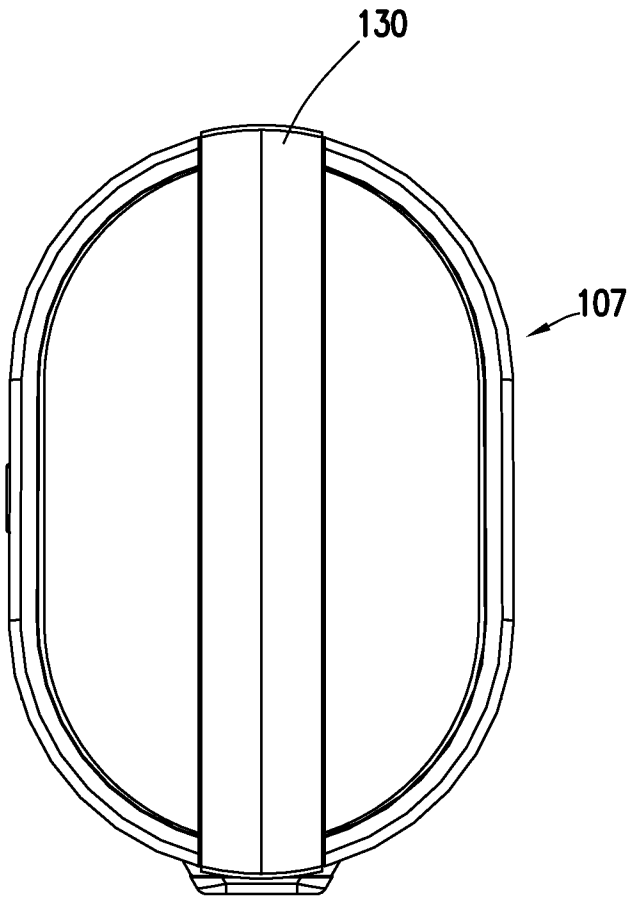
FIG. 7 is a bottom view of the portable light device of FIG. 1 in accordance with an example embodiment.
Figure 8:
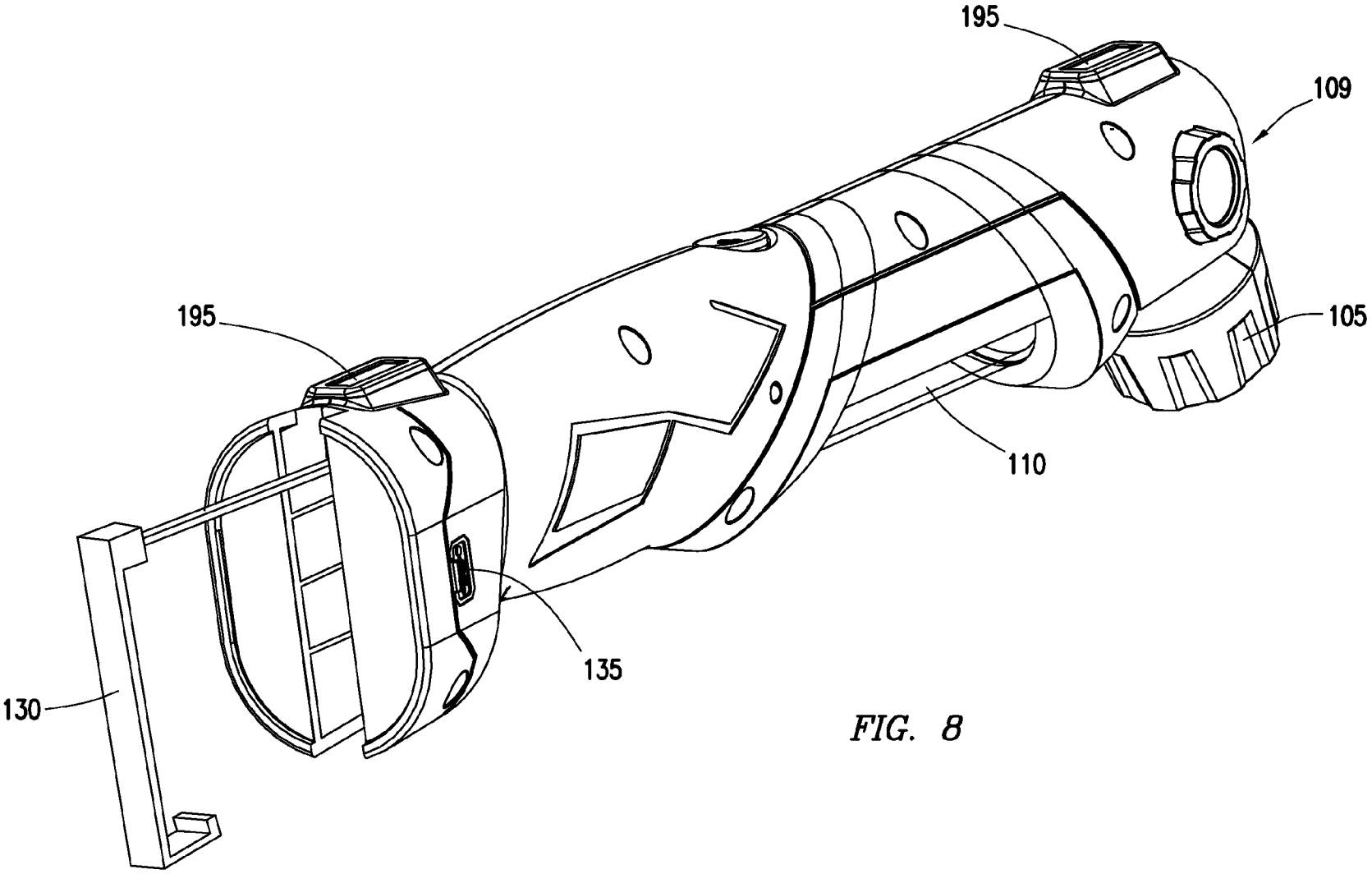
FIG. 8 is another perspective view of the portable light device of FIG. 1 illustrating the headlight in an adjusted position and a hook mechanism in an extended position in accordance with an example embodiment.

Referring to FIGS. 1-8 which illustrate a plurality of views of an example embodiment of the portable light device 100, the portable light device 100 may include an elongated body 102 having a first end 106 and a second end 107. In one example embodiment, a headlight 105 that is configured to provide high intensity light intended for distance sight and/or high intensity task lighting may be mounted on the first end 106 of the portable light device 100, as illustrated in FIG. 1. Alternatively, in some embodiments, the headlight 105 may be mounted to the second end 107 of the portable light device 100. The headlight 105 may be adjustable, i.e., the headlight 105 may be configured to rotate and/or pivot such that the headlight 105 can be directed at a variety of angles. One such example angle or position to which the headlight 105 is rotated is illustrated in the embodiment of FIG. 8. In particular, in FIG. 8, the headlight 105 is rotated to an example position that provides light in the same general direction as the floodlight panel 110. In other words, when the headlight 105 is rotated to the example position illustrated in FIG. 8, the portable light device 100 provides both high intensity spot light from the headlight 105 and general area illumination from the floodlight panel 110 to a same general area. Even though FIGS. 1-8 illustrate a headlight 105 that is adjustable, one of ordinary skill in the art can understand and appreciate that a portable light device 100 having a headlight that is not adjustable is within the broader scope of this disclosure.

In one example embodiment, the headlight 105 may be coupled to the elongated body 102 via a roller ball like member as illustrated in FIGS. 1-6. The roller ball like member may be coupled to the elongated body 102 at coupling points 109*a* and 109*b*. Further, the roller ball like member may be rotatable about an axis that passes through the coupling points 109*a* and 109*b*, which in turn rotates the adjustable headlight 105. One of ordinary skill in the art can understand and appreciate that any other appropriate pivoting and rotating mechanism can be used to adjust the headlight 105.

In particular, the headlight 105 may include one or more light sources 602 (shown in 'FIG. 6') positioned approximately in the optical center 1006 of a reflector 104. The one or more light sources 602 may be placed on a circuit board 902 and at least a portion of the reflector 104 may be in contact with the circuit board 902. However, one of ordinary skill in the art can understand and appreciate that in some configurations the reflector 104 may be arranged such that it is coupled to the circuit board 902, but not in direct contact. In some embodiments, the one or more light sources 602 may be positioned at an offset from the optical center of the reflector 104. The reflector 104 may be described in greater detail below in association with FIGS. 6, 9, and 10.

Figure 6:
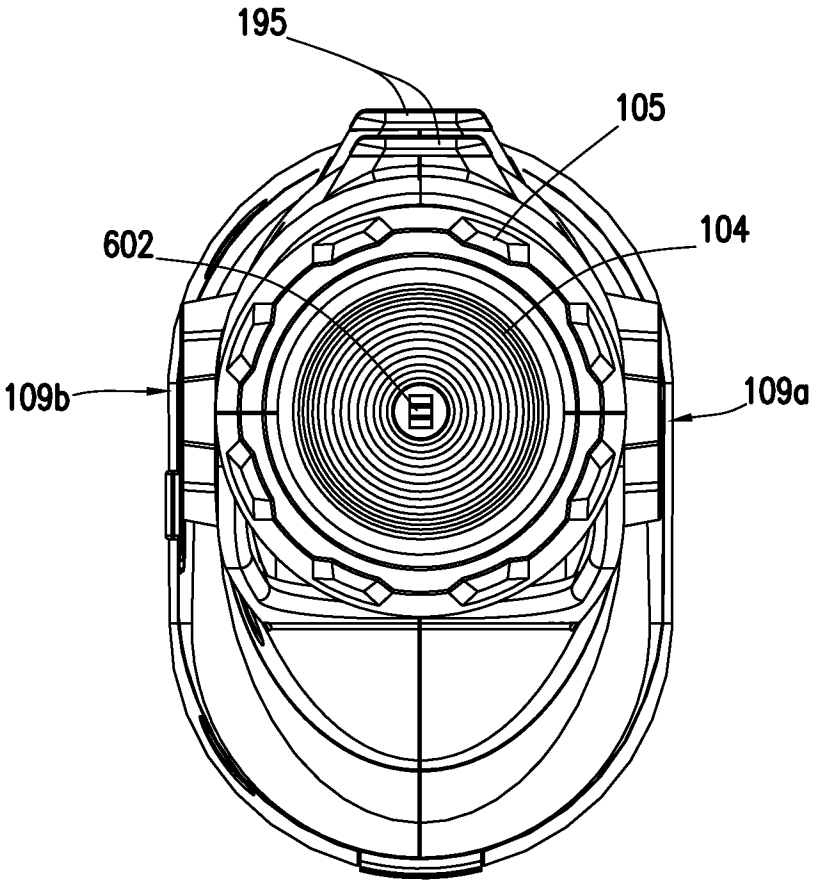
FIG. 6 is a top view of the portable light device of FIG. 1 in accordance with an example embodiment.
Figure 9:
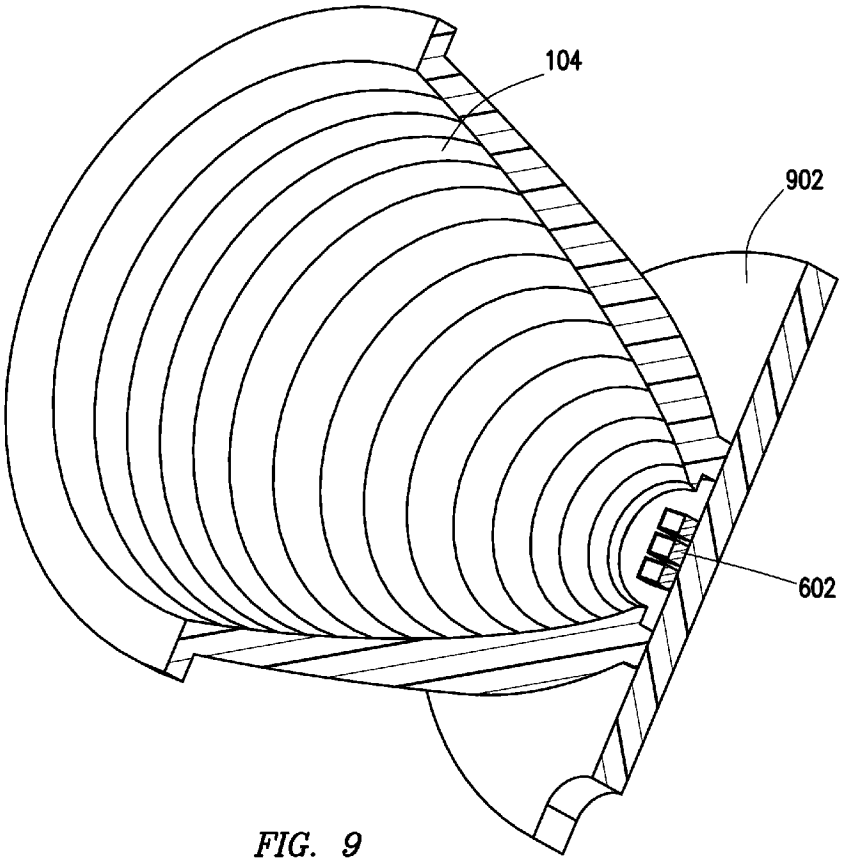
FIG. 9 is an enlarged view of the headlight illustrating a reflector with facets in accordance with an example embodiment.
Figure 10:
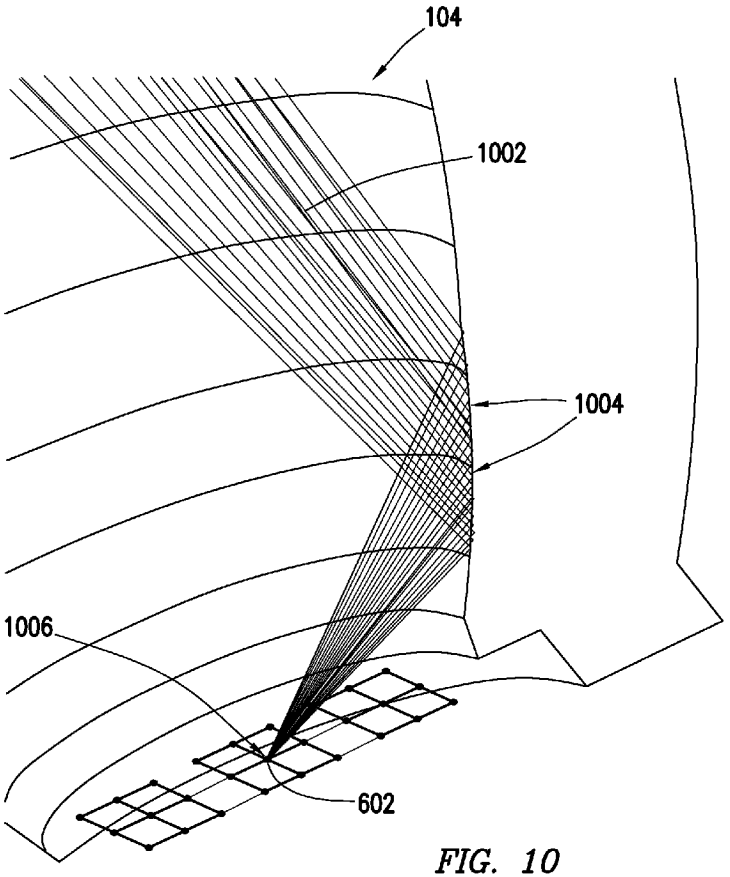
FIG. 10 illustrates mixing of light rays within the headlight by the reflector with facets in accordance with an example embodiment.
Figure 11:
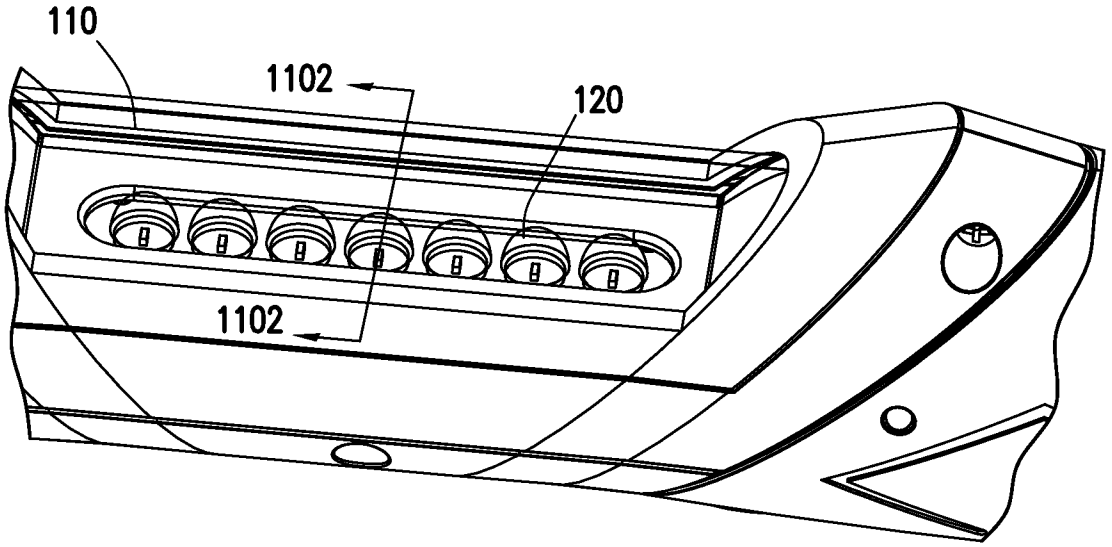
FIG. 11 illustrates an enlarged view of the floodlight panel of the portable light device of FIG. 1 in accordance with an example embodiment.

In one example embodiment, as illustrated in FIG. 6, the reflector 104 may be faceted. The facets of the reflector 104 help to avoid undesirable striations of light emitted from the one or more light sources 602 of the headlight 105. Further, the facets of the reflector 104 help to maintain a desired beam width and a desired distribution of light emitted from the one or more light sources 602 of the headlight 105, while providing a smooth beam of light. As an example, FIG. 10 illustrates how the facets of the reflector 104 facilitate mixing of the light rays emitted from one or more light sources 602 such that they create a smooth light beam, while still providing a tight, concentrated beam angle, e.g., a 10 degree beam angle. The light mixing and the beam angle control are illustrated using reference numerals 1002 of and 1004 in FIG. 10. Even though the example embodiment of headlight 105 illustrated in FIGS. 6, 9 and 10 shows a faceted surface, one of ordinary skill in the art can understand and appreciate that in some embodiments, the reflector 104 may not be faceted and may have a smooth surface.

In one example embodiment, the reflector 104 may be polished, whereas in another example embodiment, the reflector 104 may be unpolished. In one example, the reflector 104 may be vertically faceted as illustrated in FIGS. 6, 9 and 10. The vertically faceted reflector 104 may include concentric edges defining each facet and formed on an interior surface of the reflector 104. In one embodiment, the concentric edges may be equidistant or approximately equidistant from each other. However, in other embodiments, the concentric edges may not be spaced equally from each other. In another example, the reflector may include any other appropriate type of faceting, such as spiral faceting, without departing from a broader scope of this disclosure. In yet another example, the reflector may include a textured surface instead of a faceted surface. In some embodiments, the reflector may be a hybrid reflector that has a smooth portion and a faceted portion.

In some embodiments, the headlight 105 may include a bezel that can be twisted to adjust the focus and/or intensity of the light emitted from the headlight 105. The bezel may be circumferentially arranged around an exterior portion of the headlight 105. One of ordinary skill in the art can understand and appreciate that the headlight 105 may include any other appropriate automatic or mechanical focus mechanisms without departing from a broader scope of this disclosure.

Figure 4:
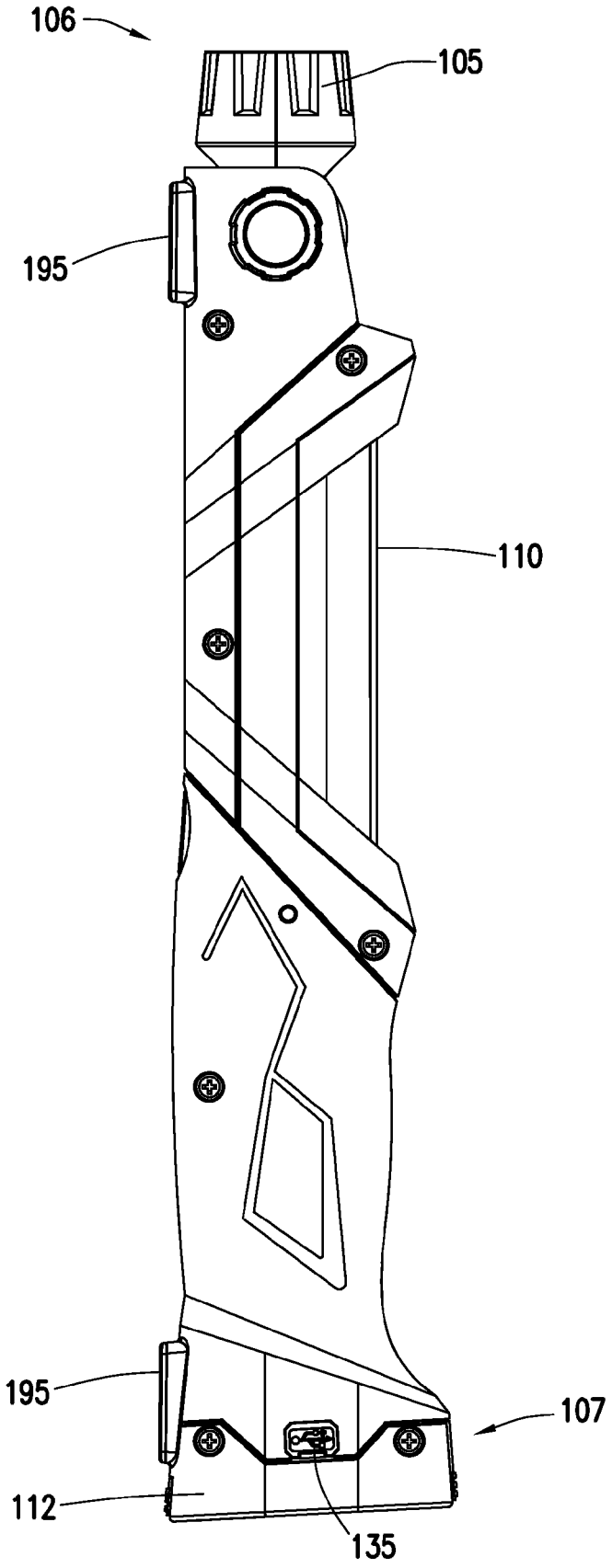
FIG. 4 is a side view of one side of the portable light device of FIG. 1 in accordance with an example embodiment.
Figure 5:
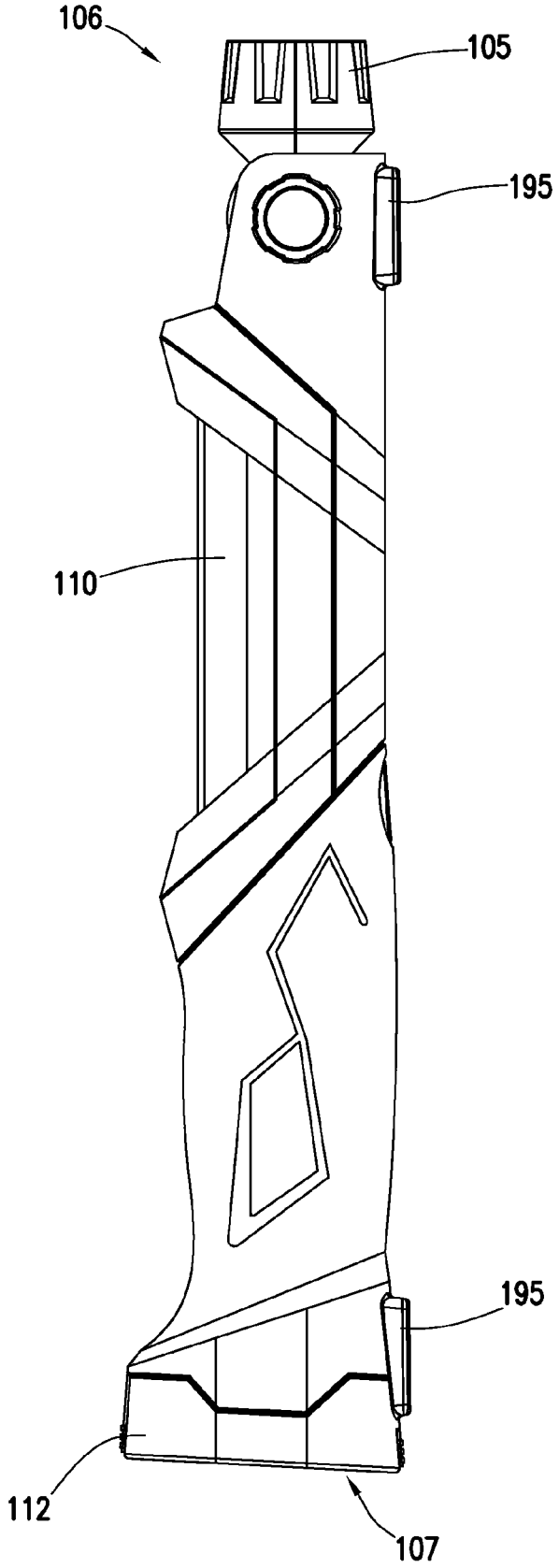
FIG. 5 is a side view of another side of the portable light device of FIG. 1 in accordance with an example embodiment.

Referring again to FIG. 1, the second end 107 of the elongated body 102 includes a base 112. Alternatively, in some embodiments, the first end 107 may include the base 112. In one embodiment, the base 112 may be detachable member, whereas in another embodiment, the base 112 may be integrated with the elongated body 102. As shown in FIG. 4, the base 112 of the portable light device 100 may include a micro-USB port 135 for charging the portable light device 100. However, one of ordinary skill in the art can understand and appreciate that the micro-USB port 135 can be positioned at any other portion along the elongated body of the portable light device 100. Further, one of ordinary skill in the art can understand and appreciate that the micro-USB port can be replaced with any other appropriate charging ports such as a mini-USB port, a regular USB port, an AC charging port, and so on without departing from a broader scope of this disclosure. Alternatively, another charging port that supports a different charging mechanism other than micro-USB charging may be provided in addition to the micro-USB port 135. In some example embodiments, the portable light may be configured to operate using renewable energy, such as solar power.

As described above, in addition to the headlight 105, the portable light device 100 may include a floodlight panel 110 that is located at a front portion 101 (herein interchangeably referred to as 'front side') of the elongated body 102. In another example embodiment, the floodlight panel 110 can be positioned on a back portion 103 (herein interchangeably referred to as 'back side') or any other appropriate portion of the elongated body 102, without departing from a broader scope of this disclosure.

Figure 12:
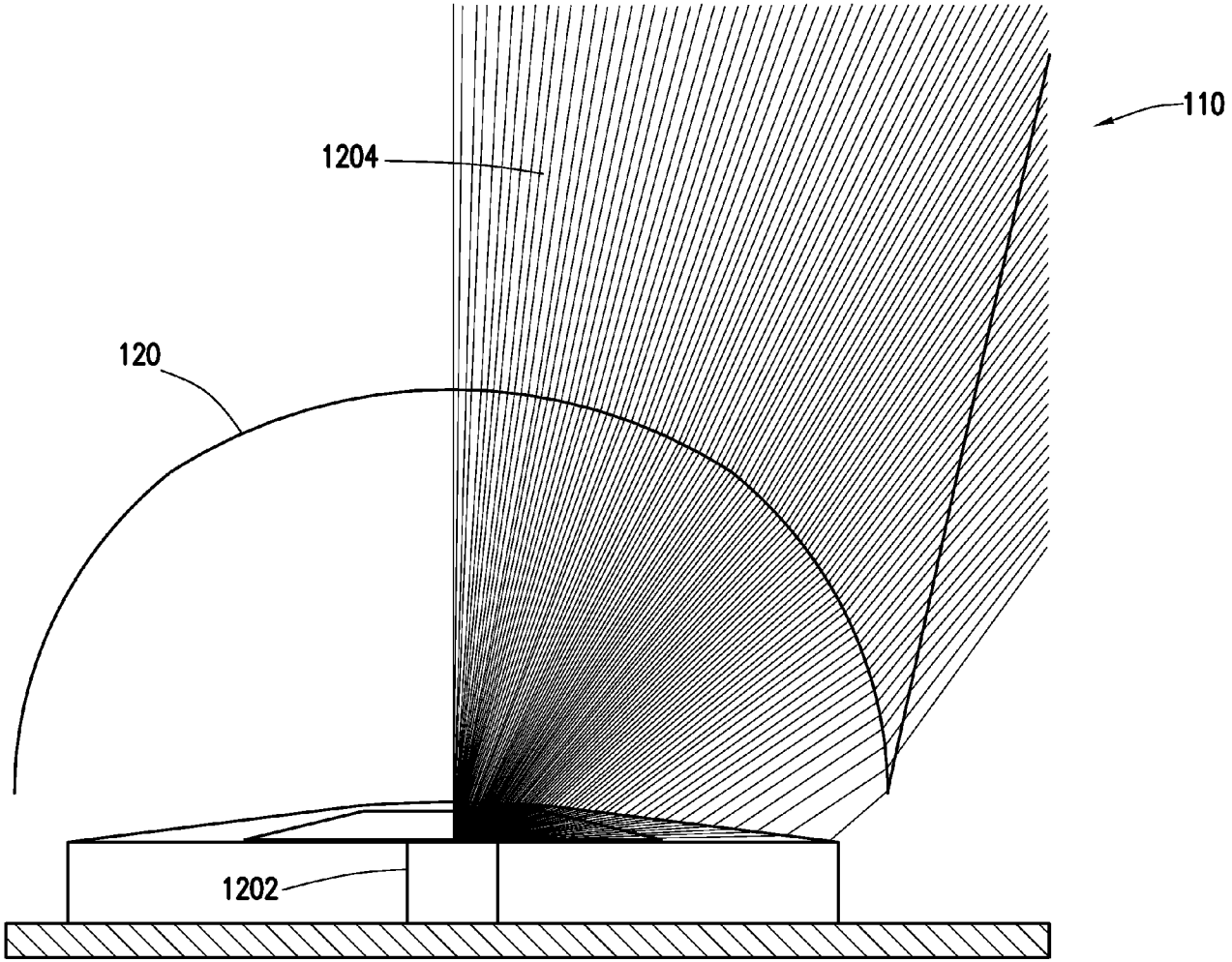
FIG. 12 illustrates a cross-sectional view of a portion of the floodlight panel in accordance with an example embodiment.

In one example embodiment, the floodlight panel 110 may be configured to provide general area illumination or general task lighting. Accordingly, the floodlight panel 110 may include an array of light sources. Each light source of the floodlight panel 110 may be covered by a primary optic 120, as illustrated in FIGS. 1, 2, 11, and 12. In particular, the primary optic 120 may be disposed on a substrate that holds the light sources (e.g., a circuit board) such that the edges of the primary optic are in contact with the substrate. Hereinafter, the primary optic may be referred to as blob-style optic. The blob-style optic 120 may be configured to focus the light emitted from each light source 1202 of the floodlight panel 110 while maintaining an even distribution of the light, as illustrated in FIG. 12. In one example, the blob-style optic 120 focuses light emitted from each light source 1202 of the floodlight panel 110 to approximately a 60 degree beam angle. Test data representative of such a blob-style optic is provided below in Table 1.

TABLE 1

Zonal Lumen Summary

| Zone | Lumens | % Lamp | % Fixt |
|---|---|---|---|
| 0-30 | 125 | 69.1 | 81.0 |
| 0-40 | 152 | 83.6 | 97.3 |
| 0-60 | 154 | 84.9 | 99.4 |
| 0-90 | 155 | 85.4 | 100.0 |
| 90-120 | 0 | 0.0 | 0.0 |
| 90-150 | 0 | 0.0 | 0.0 |
| 90-180 | 0 | 0.0 | 0.0 |
| 0-180 | 155 | 85.4 | 100.0 |

Total Luminaire Optical Efficiency = 85.4%

As can be seen from the data in Table 1, the majority of the lumens emitted by the floodlight panel 110 with the example blob-style optic 120 fall within a 60 degree beam angle.

One of ordinary skill in the art can understand and appreciate that the 60 degree beam angle is an example beam angle and is not limiting. In other words, the blob-style optic 120 can be designed to achieve a beam angle that is lesser than or greater than 60 degrees without departing from a broader scope of this description. Detailed examples of blob-style optic 120 can be found in U.S. Pat. No. 8,430,538, U.S. Pat. No. 7,854,536, and U.S. Pat. No. 8,545,049 assigned to the assignee of the present application, the disclosure of each patent being incorporated herein by reference, in relevant parts.

One of ordinary skill in the art can understand and appreciate that the light sources 1202 and 602 of the floodlight panel 110 and the headlight 105 respectively, can include, but are not limited to, light emitting diodes (LEDs), flouroscent lamps, and other light sources without departing from a broader scope of this disclosure.

In addition to the headlight 105, the floodlight panel 110, and the base 112, as illustrated in FIGS. 1-5 and 8, the portable light device 100 may include a pair of magnets 195 disposed on the back side 103 of the portable light device 100. Alternatively, in some embodiments, the one or more magnets 195 can be located at any other portion of the portable light. The magnets 195 provide various mounting positions for easy mounting and hands free operation of the portable light device 100.

Figure 3:
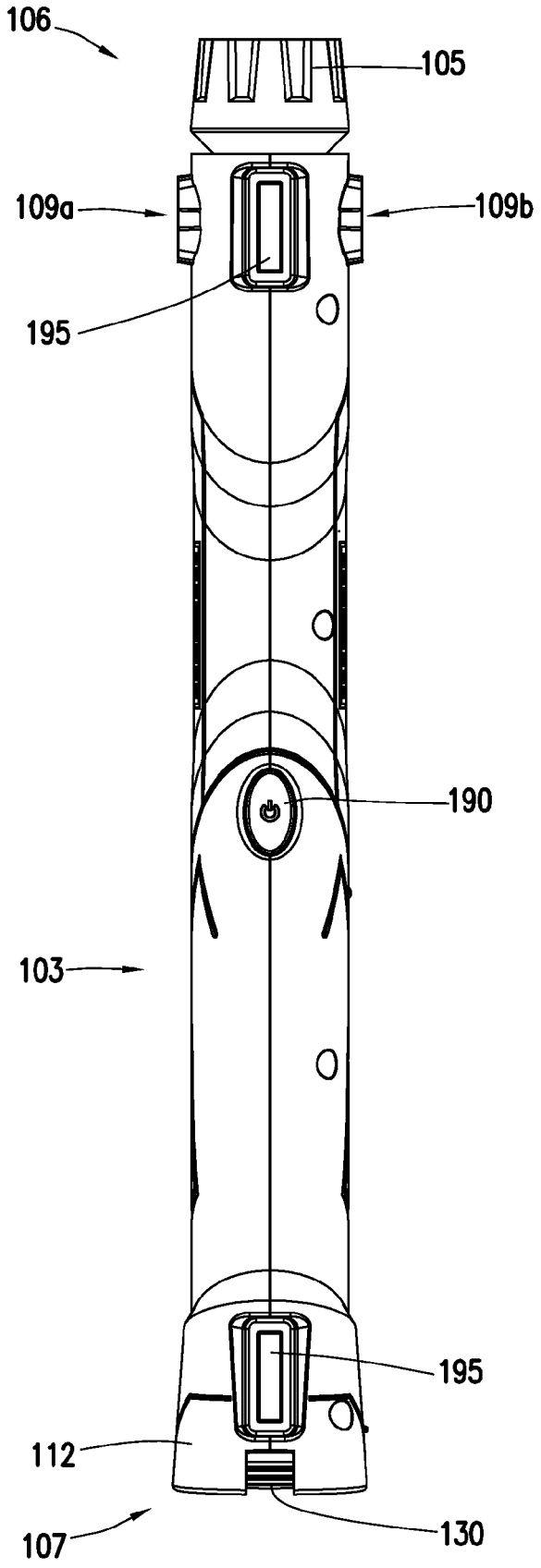
FIG. 3 is a back view of the portable light device of FIG. 1 in accordance with an example embodiment.

As illustrated in FIGS. 3 and 7, the portable light device 100 may also include a hooking mechanism 130 located at the base 112 of the portable light device 100. In one example embodiment, the hooking mechanism 130 includes a hook that can extend from the base 112 and can be used to hang the portable light device 100. The hook is disposed in a channel internal to the base 112. The channel internal to the base 112 may include a friction mechanism to keep the hook in place and to retain an extended position when the hook is extended for hanging the portable light device 100 as illustrated in FIG. 8. When the hooking mechanism 130 is not in use, the hook can slide back into the channel internal to the base of the portable light device 100 so that it does not interfere with use of the portable light device 100. In some example embodiments, the hook may be rubber coated to provide friction when the hook engages a surface to which the portable light device 100 is hooked.

In addition, as illustrated in FIG. 3, the portable light device 100 may include a power switch 190 that is configured to select and/or control the headlight 105 and/or the floodlight panel light 110. The example power switch 190 as illustrated in FIG. 3 may be disposed on the back side 103 of the elongated body 102. However, one of ordinary skill in the art can understand that the power button can be positioned at any other appropriate portion of the elongated body, without departing from a broader scope of this disclosure. In one example embodiment, the power switch 190 may be a four-pole selector switch having four states of operation that allows a user to select and/or control the headlight 105 and/or the floodlight panel 110. For example, a first pressing of the switch may switch on the floodlight panel 105, a second pressing of the switch may switch on the headlight 110, a third pressing of the switch may turn on both the floodlight panel 110 and the headlight 105, and a fourth pressing of the switch may switch off both the floodlight panel 110 and the headlight 105. In another example embodiment, the four states of operation may be accomplished by software logic and a momentary switch where a user can cycle through the switching operations based on a duration of pressing the switch. One of ordinary skill in the art can understand that the four states of operation are example states and are not limiting. That is, the power switch can be configured to have less than or more than four states of operation. For example, the power switch can be configured to individually control each LED 1202 of the floodlight panel 110. One of ordinary skill in the art can understand and appreciate that the power switch 190 can include, but is not limited to, a side click button or switch, a tailcap click switch, a membrane press switch/button, a side slide switch, a magnetic reed switch, and so on. That is, in some example embodiments, the power switch 190 may be replaced by a bezel twist switching mechanism or a tailcap twist switching mechanism as described above.

In one example embodiment, the portable light device 100 may include touch based mechanism for controlling the adjustable light 105, the floodlight panel 110, and/or other features of the portable light device 100. In another example embodiment, the portable light device 100 may include a fingerprint scanning or biometric scanning mechanism for activating or controlling one or more features of the portable light device 100. In some example embodiments, the portable light device 100 may include a display mechanism (indicator LED's) or a display panel with text display disposed on any appropriate portion of the portable light device 100 to indicate the status of various features of the portable light, such as if the portable light is fully charged, the lights needs to be replaced, a direction such as a compass feature, a temperature, etc. The display panel may be activated by touch or other switch mechanisms, and to preserve power, the display panel may be activated only as needed. When not being used, the display panel may be switched off or in a sleep mode. In an alternate embodiment, the display panel or mechanism may remain switched on at all times.

Even though the example embodiment of the portable light device 100 in FIGS. 1-6 illustrates a substantially straight elongated body 102 from the first end 106 to the second end 107, one of ordinary skill in the art can understand that the elongated body 102 of the portable light device 100 can be contoured (curved shape). One of ordinary skill in the art can also understand and appreciate that the elongated body 102 can have any other appropriate shape, such as any geometric polyhedron shape or any non-geometric polyhedron shape. For example, the elongated body 102 may be shaped as a cylinder or a cuboid in some embodiments or may have a rectangular cross-section along its length.

Although the disclosure refers to example embodiments, it should be appreciated by those skilled in the art that various modifications are well within the scope of the disclosure. From the foregoing, it will be appreciated that an embodiment of the disclosure overcomes the limitations of the prior art. Those skilled in the art will appreciate that the disclosure is not limited to any specifically discussed application and that the embodiments described herein are illustrative and not restrictive. From the description of the example embodiments, equivalents of the elements shown therein will suggest themselves to those skilled in the art, and ways of constructing other embodiments of this disclosure will suggest themselves to practitioners of the art. Therefore, the scope of this disclosure is not limited herein.

What is claimed is:

1. A portable light device, comprising:

a headlight disposed at one end of the portable light device and comprising a reflector with facets and at least one headlight light source; and a floodlight panel disposed on a front side of the portable light device and comprising one or more floodlight light sources, wherein each of the one or more floodlight light sources is covered by a respective primary optic, wherein the headlight is adjustable to provide a first beam of light in a same direction as a second beam of light emitted by the floodlight panel.

2. The portable light device of claim 1, further comprising a micro-USB port.

3. The portable light device of claim 1, further comprising a retractable hook.

4. The portable light device of claim 1, further comprising at least two magnets disposed on a back side of the portable light device.

5. The portable light device of claim 1, further comprising a power switch to control at least one of the floodlight panel and the headlight.

6. The portable light device of claim 1, wherein the first beam of light from the headlight is of greater intensity than the second beam of light emitted by the floodlight panel.

7. The portable light device of claim 1, wherein the respective primary optic produces a beam angle of approximately 60 degrees.

8. A portable light device, comprising:

an elongated body having a first end and a second end;

a headlight disposed at the first end of the elongated body and comprising at least one headlight light source;

the second end of the elongated body comprising a base; and a floodlight panel disposed on a front side of the elongated body and comprising one or more floodlight light sources, wherein the headlight disposed at the first end of the elongated body is adjustable to provide a first beam of light in a same direction as a second beam of light emitted by the floodlight panel.

9. The portable light device of claim 8, further comprising a micro-USB port.

10. The portable light device of claim 8, further comprising a retractable hook that is extendable from the base.

11. The portable light device of claim 8, further comprising at least two magnets disposed on a back side of the elongated body.

12. The portable light device of claim 8, further comprising a power switch to control at least one of the floodlight panel and the headlight.

13. The portable light device of claim 8, wherein the first beam of light from the headlight is of greater intensity than the second beam of light emitted by the floodlight panel.

14. The portable light device of claim 8, wherein each of the one or more floodlight light sources is covered by a respective primary optic that produces a beam angle of approximately 60 degrees.

15. A portable light device, comprising:

a headlight disposed at one end of the portable light device and comprising a reflector with facets and at least one headlight light source positioned approximately in an optic center of the reflector with facets; and a floodlight panel disposed on a front side of the portable light device and comprising one or more floodlight light sources, wherein each of the floodlight light sources is covered by a respective primary optic, and wherein the headlight is adjustable to provide a first beam of light in a same direction as a second beam of light emitted by the floodlight panel.

16. The portable light device of claim 15, further comprising a micro-USB port.

17. The portable light device of claim 15, further comprising a retractable hook.

18. The portable light device of claim 15, further comprising at least two magnets disposed on a back side of the portable light device.

19. The portable light device of claim 15, further comprising a power switch to control at least one of the floodlight panel and the headlight.

20. The portable light device of claim 15, wherein the respective primary optic produces a beam angle of approximately 60 degrees.

* * * * *